US005419392A

United States Patent [19]

Maruyama

[11] Patent Number: 5,419,392

[45] Date of Patent: May 30, 1995

[54] HEAT EXCHANGING APPARATUS

[76] Inventor: Noboru Maruyama, 2-26-14 Shirasagi, Nakano-ku, Tokyo, Japan

[21] Appl. No.: 191,608

[22] Filed: Feb. 4, 1994

[30] Foreign Application Priority Data

Feb. 10, 1993 [JP] Japan ..... 5-022405

[51] Int. Cl.[6] ..... F28D 1/06

[52] U.S. Cl. ..... 165/163; 165/140

[58] Field of Search ..... 165/140, 163, 164

[56] References Cited

U.S. PATENT DOCUMENTS

| | | | |
|---|---|---|---|
| 2,160,898 | 6/1939 | Peff | 165/140 X |
| 2,612,357 | 9/1952 | Parks | 165/140 X |
| 3,018,089 | 1/1962 | Caughill et al. | 165/163 X |
| 3,422,887 | 1/1969 | Berkeley, III | 165/163 |
| 4,107,410 | 8/1978 | Toekes | 526/73 |
| 4,306,618 | 12/1981 | Honkajärvi | 165/163 |
| 4,479,533 | 10/1984 | Persson et al. | 165/140 |
| 4,611,655 | 9/1986 | Molignoni | 165/163 |
| 4,619,317 | 10/1986 | Disselbeck et al. | 165/162 |

FOREIGN PATENT DOCUMENTS

| | | | |
|---|---|---|---|
| 1404208 | 11/1968 | Germany | 165/163 |

*Primary Examiner*—Allen J. Flanigan
*Attorney, Agent, or Firm*—Kenneth E. Kuffner

[57] ABSTRACT

The heat absorbing member formed by connecting the bottom portion of the inlet header (1) with that of the outlet header (2) through a heat absorbing tube installed so that the heat absorbing tube is located in a heating container (9). The heat absorbing tube (16) is comprised of a plurality of down tubes (3, 5) and down tubes (4, 6) all with lower ends closed and connected under the inlet header (1) and outlet header (2) respectively, and spiral tubes (7, 8) which connect to the bottom portion of the down tubes (3, 5) and to the top portion of the down tubes (4, 6), and wherein the spiral tubes (7, 8) are of the same length.

8 Claims, 2 Drawing Sheets

HEAT EXCHANGING APPARATUS

BACKGROUND OF THE INVENTION

The present invention relates to an apparatus for heat exchange between liquids, gas and liquid, and gases, and more particularly, between liquids.

As the conventional heat exchanging apparatus has often been used as such between the heating medium, which is either a high temperature liquid or gas, and the liquid as shown in FIG. 3, this is used as an example for description. In this apparatus, a heat absorbing member 30 comprising of a heat absorbing tube 31 connecting a bottom portion of an inlet header 1 with that of an outlet header 2, with the heat absorbing tube 31 below the outlet header 2 being of a spiral form, is installed while locating the heat absorbing tube 31 inside the heating container 9. The heating container 9 is provided with a heating medium inlet 11 and outlet 12, respectively for supply and discharge of the heating medium.

In heating the liquid by the above type of heat exchanging apparatus while the liquid is supplied from the inlet header 1 into the heat absorbing tube 31, the heating medium is supplied through the heating medium inlet 11 into the heating container 9. The hot water obtained through heat exchange between the heating medium and the liquid in the heat absorbing tube 31 is supplied through the outlet header 2 to the load unit (not shown). On the other hand, the heating medium is discharged through the heating medium outlet 12. If this heat exchanging apparatus is used to supply hot water to a plurality of load units, such as three load units including heater 13, a hot water supply unit 14, and a bathtub 15, as shown in FIG. 4, three heat absorbing members 30A, 30B, and 30C must be installed in the heating container 9 in correspondence to these loads. To supply the hot water to the load, the inlet header 1A and outlet header 2A of the heat absorbing member 30A are connected to the heater 13 through a pipeline 17, in which a pump 18 is incorporated, while the water supply source 19 connected to the inlet header 1A of the heat absorbing member 30, the outlet header 2B is connected to the hot water supply unit 14 and the inlet header 1C and outlet header 2C of the heat absorbing member 30C connected to the bathtub 15 through the pipeline 21, in which the pump 20 is incorporated.

The heat exchanging apparatus of the above type has only one heat absorbing tube 31 on one heat absorbing member 30, resulting in poor heat exchange efficiency between the liquid in the heat absorbing tube 31 and the heating medium in the heating container 9. Moreover, to supply hot water to a plurality of load units, such as heaters, there must be a plurality of heat absorbing members 30 in the heating container 9. Therefore, problems arise, like the need for a large amount of heating medium as well as an increased size of the heating container 9.

SUMMARY OF THE INVENTION

It is the object of the present invention to solve the above problems associated with the conventional heat exchanging apparatus and to provide a heat exchanging apparatus which can supply hot water to a plurality of load units, such as heaters, without increasing the heating container size and without the need of a large quantity of heating medium. This heat exchanging apparatus has a plurality of heat absorbing tubes provided to one heat absorbing member, with satisfactory heat exchange efficiency accomplished between the liquid in the heat absorbing tubes and the heating medium in the heating container. Moreover, each heat absorbing tube comprises of the spiral tubes of the same length, ensuring easier procurement, stock control, and production control of the tube materials. The use of spiral tubes is made possible with concentrically arranged coils by virtue of the innermost coils having a greater height as shown in FIG. 1, thus compensating for the smaller diameter of each turn of said innermost coils.

In order to accomplish the above object, the heat exchanger according to this invention, in which the heat absorbing member formed by connecting the inlet header 1 bottom portion with that of the outlet header 2 through the heat absorption tube is installed so that the heat absorbing tube is located in the heating container 9, is characterized by the heat absorbing tube 16 comprising of a plurality of down tubes 3 and 4 and the down tubes 5 and 6, all with the lower end closed and respectively installed under the inlet header 1 and outlet header 2, and spiral tubes 7 and 8 connecting the top portion with the bottom portion of down tubes 3 and 4 and down tubes 5 and 6 and also characterized by the same length of spiral tubes 7 and 8. Further more, according to the present invention, a plurality of sets of heat absorbing members 10 have the spiral tubes 7 and 8 concentrically arranged and the inlet and outlet headers 1 and 2 located on approximately the same plane. In addition, according to the present invention, the diameter of spiral tubes 7 and 8 differs among sets of heat absorbing tubes 10. In the afore-mentioned heat exchanging apparatus, to heat the fluid, it is supplied from the inlet header 1 of the heat absorbing member 10 to the down tubes 3 and 5 and is allowed to flow from their lower ends into the connected spiral tubes 7 and 8 to rise and reach the outlet header 2 through the top portion of the down tubes 4 and 6. On the other hand, the heating medium is supplied into the heating container 9 for heat exchange with the fluid in down tubes 3, 4, 5, and 6 and in spiral tubes 7 and 8. The fluid thus heated is supplied from the outlet header 2 to the load unit while the heating medium is discharged from the heating container 9. When the heated fluid is to be supplied from the heat exchanging apparatus according to the present invention to a plurality of load units, the outlet headers 2A, 2B, and 2C of the corresponding number of heat absorbing members 10A, 10B, and 10C are connected to the respective load units, enabling a supply of the heated fluid in the same manner as with a conventional heat exchanging apparatus.

BRIEF DESCRIPTION OF THE DRAWINGS

In the accompanying drawings.

DESCRIPTION OF THE PREFERRED EMBODIMENT

Figure 1:
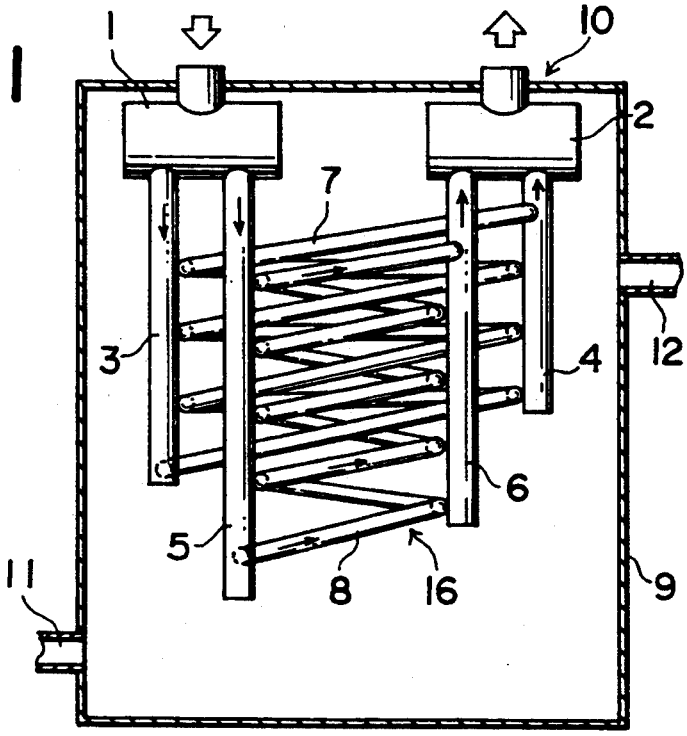
FIG. 1 is a vertical sectional front view showing a part of the first preferred embodiment of the present invention.

In the preferred embodiment of the present invention shown in the figures, the portions similar to the conventional heat exchanging apparatus are provided with the same symbols as for the conventional types, for which a description is omitted. The description here is therefore concerned only with the portion different from the conventional heat exchanging apparatus. In the first preferred embodiment shown in FIG. 1, the bottom portion of the inlet header 1 and that of the outlet header 2 of the heat absorbing unit 10 are provided with the heat absorbing tube 16 to connect these headers, and the heat absorbing tube 16 comprises of a plurality of down tubes 3 and 4 and down tubes 5 and 6, all with the lower ends closed, and the spiral tubes 7 and 8 which connect the top with the bottom portions of down tubes 3 and 4 and down tubes 5 and 6 and which are the same in length. A variation of this preferred embodiment may have a vertical multistage construction, in which the similar down tubes (not shown) are connected below the down tubes 3 and 4 and down tubes 5 and 6 and the spiral tubes 7 and 8 are connected to these down tubes in the manner described above. Down tubes 3 and 4, down tubes 5 and 6, and spiral tubes 7 and 8 make up a pair of two tubes in this preferred embodiment, but the number of tube pairs may be increased.

Figure 2:
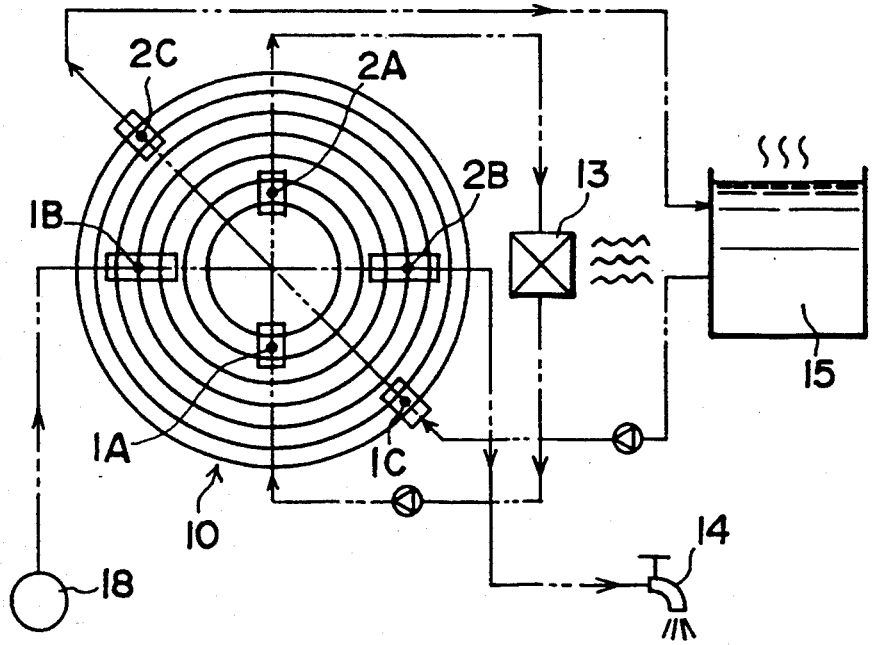
FIG. 2 is a plan view showing the use condition of the second preferred embodiment of the present invention.
Figure 3:
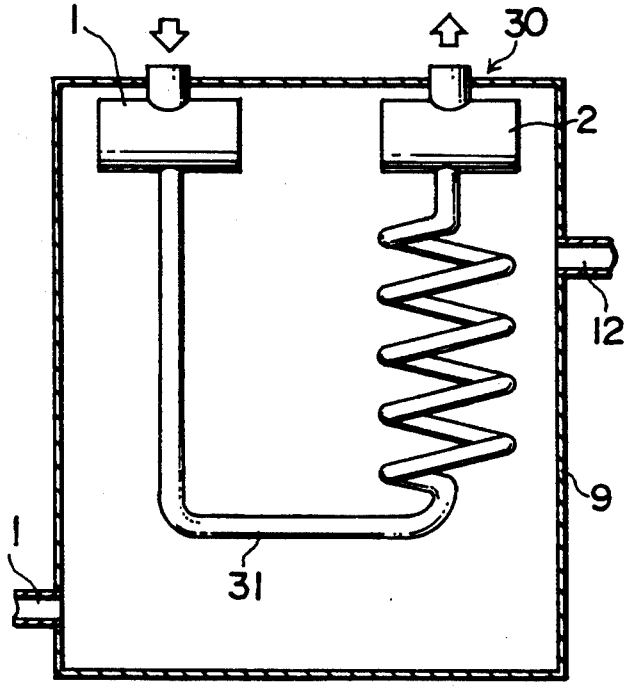
FIG. 3 is a view similar to FIG. 1, showing the conventional embodiment similar to the present invention.
Figure 4:
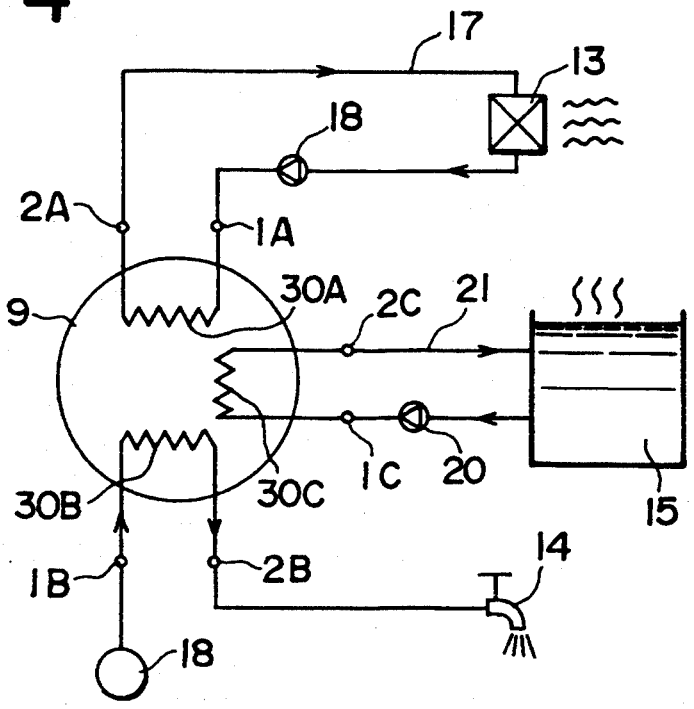
FIG. 4 is a view similar to FIG. 2 for the above conventional embodiment.

FIG. 2 shows the second preferred embodiment of the present invention. This is for a plurality of load units and supplies hot water to three load units, that is, the heater 13, hot water supply unit 14, and bathtub 15. This preferred embodiment differs from the first one in that three heat absorbing members 10A, 10B, and 10C are located so that the spiral tubes 7 and 8 are arranged concentrically in the heating container 9 and their inlet and outlet headers 1A, 1B, and 1C and 2A, 2B, and 2C are on approximately the same plane. It should be noted here that the number of heat absorbing members 10 increases or decreases depending on the quantity of load units and the plane shape of spiral tubes 7 and 8 may be circular or polygonal.

To heat the liquid with the heat exchanging apparatus according to the present invention, the liquid is supplied from the inlet header 1 of the heat absorbing member 10 to the down tubes 3 and 5, through the bottom portion of which the liquid is supplied to rise through the spiral tubes 7 and 8 to the outlet header 2 through the top of the down tubes 4 and 6. At the same time, the heating medium is supplied from the heating medium inlet 11 into the heating container 9 in which heat exchange is achieved between this heating medium and the liquid in the down tubes 3 and 4 as well as in 5 and 6 and in the spiral tubes 7 and 8. The hot water thus heated is then supplied through the outlet header 2 to the load unit (not shown), while the heating medium is discharged through the heating medium outlet 12. To supply hot water from a heat exchanging apparatus of this type to three load units of the heater 13, hot water supply unit 14, and bathtub 15, the output header 2A, 2B, and 2C of three heat absorbing members 10A, 10B, and 10C, respectively corresponding to each of the above three loads, are connected to the heater 13, hot water supply unit 14, and bathtub 15, supplying the hot water in the same manner as a conventional heat exchanging apparatus. Fluid to be heated in the above preferred embodiment was liquid, but may also be gas, for instance, that which is used in a drying room.

As the length is the same for both spiral tubes 7 and 8 in the above preferred embodiment, the straight tubes from which these spiral tubes are manufactured are also the same in length regardless of whether the raw tubes are the drawn or welded tubes. Therefore, it is not necessary to prepare tubes of different lengths based on the calculation made for the manufacture of spiral tubes 7 and 8. This in turn makes procurement, stock control, and production control of raw material tubes and adaptation of multi-product small-lot manufacture easier. By varying the diameter of spiral tubes 7 and 8 for each set of heat absorbing members 10, it becomes possible for the supply of hot water to use the small size spiral tubes 7 and 8 in such places as a washstand or kitchen where a small quantity of hot water is used frequently or to use large size spiral tubes 7 and 8 in such places as a large bath or pool where a large quantity of hot water is used for a long period of time.

As so far described, the present invention comprising of a plurality of heat absorbing tubes provided to one heat absorbing member ensures a superior heat exchange efficiency between the liquid in the heat absorbing tube and the heating medium in the heating container. Each heat absorbing tube is made from spiral tubes of the same length, making procurement, stock control, and production control of raw tube materials easier. Moreover, the present invention produces a supply of hot water of the right temperature and quantity to the load units, such as a plurality of heaters, etc., without increasing the size of the heating container and without requiring a large quantity of heating medium.

What is claimed is:

1. A heat exchanging apparatus in which a heat absorbing member, formed by connecting a bottom portion of inlet header (1) with that of outlet header (2) through a heat absorbing tube (16), is installed in a heating container (9), characterized in that the heat absorbing tube (16) comprises of a plurality of inlet down tubes (3, 5) and outlet down tubes (4, 6), all with lower ends closed, and hydraulically connected to and suspended underneath the inlet header (1) and the outlet header (2) respectively, and spiral tubes (7, 8), hydraulically connected to the bottom portion of said inlet down tubes (5) and (3) respectively, and, hydraulically connected to the top portion of said outlet down tubes (4) and (6) respectively, all said spiral tubes (7, 8) being the same length.

2. The heat exchanging apparatus according to claim 1, wherein a plurality of heat absorbing members (10) are concentrically arranged with said inlet and outlet headers (1, 2) located on approximately the same plane.

3. A heat exchanging apparatus according to claim 2, wherein the diameter of spiral tubes (7, 8) differs among sets of the heat absorbing member (10).

4. A heat exchanging apparatus in which a heat absorbing member, formed by connecting a bottom portion of inlet header (1) with that of outlet header (2) through a heat absorbing tube (16), is installed in a heating container (9), characterized in that the heat absorbing tube (16) comprises a plurality of inlet down tubes (3, 5) and outlet down tubes (4, 6), all with lower ends closed, and hydraulically connected to and suspended underneath the inlet header (1) and the outlet header (2) respectively, and the spiral tubes (7, 8), hydraulically connected to the bottom portion of said inlet down tubes (5) and (3) respectively, and hydraulically connected to the top portion of said outlet down tubes (4) and (6) respectively, all said spiral tubes (7, 8) being the same length, and wherein a plurality of sets of heat absorbing members (10), each having the spiral tubes (7, 8) concentrically arranged with said inlet and outlet headers (1, 2) located on approximately the same plane.

5. The heat exchanging apparatus according to claim 4, wherein the diameter of spiral tubes (7, 8) differ among sets of the heat absorbing member (10).

6. A heat exchanging apparatus adapted to be submerged in a container of heating fluid comprising a set of heat absorbing tubes hydraulically connected between and suspended underneath the bottom portions of a fluid inlet header and a fluid outlet header, further characterized in that said set of heat absorbing tubes comprises a pair of outlet header down tubes extending downwardly from the fluid outlet header and having their lower ends closed off, a pair of inlet header down tubes extending downwardly from the fluid inlet header and having their lower ends closed off, and a pair of spiral tubes, each spiral tube hydraulically connected at one end to the bottom portion of an inlet header down tube and at the opposite end to the top portion of an outlet header down tube, respectively.

7. A heat exchanging apparatus as in claim 6 wherein the length of each spiral tube is the same.

8. A heat exchanging apparatus as in claim 7 further comprising at least one additional distinct set of heat absorbing tubes and wherein the spiral tubes of each such set are sized with respect to the spiral tubes of each other set so that the heat absorbing tubes of the overall apparatus are arranged in concentric fashion.

* * * * *